US007506796B1

(12) United States Patent
Hanna

(10) Patent No.: US 7,506,796 B1
(45) Date of Patent: Mar. 24, 2009

(54) MAIL DELIVERY NOTIFICATION DEVICE

(75) Inventor: Robert Lee Hanna, Rock Island, IL (US)

(73) Assignee: Robert L. Hanna, Rock Island, IL (US)

( * ) Notice: Subject to any disclaimer, the term of this patent is extended or adjusted under 35 U.S.C. 154(b) by 0 days.

(21) Appl. No.: 12/012,417

(22) Filed: Feb. 2, 2008

(51) Int. Cl.
*A47G 29/12* (2006.01)

(52) U.S. Cl. ..... 232/36; 340/569; 340/689; 200/61.52; 200/61.63

(58) Field of Classification Search ..... 232/34–37; 340/569, 545.6, 689; 200/61.52, 61.63; 49/13–14; 109/43
See application file for complete search history.

(56) References Cited

U.S. PATENT DOCUMENTS 4,872,210 A * 10/1989 Benages ..... 340/569
5,023,595 A * 6/1991 Bennett ..... 340/569
5,060,854 A * 10/1991 Armstrong ..... 232/37
5,247,282 A * 9/1993 Marshall ..... 340/569
5,440,294 A * 8/1995 Mercier et al. ..... 340/569
6,046,675 A * 4/2000 Hanna ..... 340/569
6,694,580 B1 * 2/2004 Hatzold ..... 232/36
2002/0166756 A1 * 11/2002 Thompson ..... 200/61.52
2003/0085631 A1 * 5/2003 Cech et al. ..... 310/319
2006/0144918 A1 * 7/2006 Hutchinson ..... 232/35

* cited by examiner

*Primary Examiner*—William L. Miller

(57) ABSTRACT

A transmitting mechanism for indicating the deposit of mail into mailboxes having doors that pivot about a horizontal hinge. Such mailboxes normally identified as curb side, wall mounted, and slot type. The transmitting mechanism is comprised of an adjustable knob capable of positioning an adjoining tilt switch, such that the mechanism can be set to send a signal at any preferred mailbox opening. As the mailbox door is opened past a predetermined angle, the tilt switch completes a circuit which emits a signal to a remote receiver which activates a sound and visual alarm indicating that mail has been deposited in the mailbox.

7 Claims, 7 Drawing Sheets

MAIL DELIVERY NOTIFICATION DEVICE

BACKGROUND OF THE INVENTION

1. Field of the Invention

This invention relates to devices which indicate when mail has been deposited in a mailbox.

2. Related Art

Many efforts have been made in the past to devise a mechanism that signals when mail has been deposited in a mailbox. These signaling devices are designed to eliminate any special trips to mailboxes that are located somewhat remote from a residence or business. And in addition, also for the need to observe if mail has been deposited in mailboxes which are mounted to the structure of a residence or business.

A first type of prior art which signals the arrival of mail is the mechanical triggering type device. These devices typically senses the opening and closing of the mailbox door by the mailman. A typical mechanical trigger device is shown in U.S. Pat. No. 4,520,350, which has a button which is depressed in abutment with the closed mailbox door As the door opens away from the button, a spring presses the button outwardly. The button triggers an electrical signaling system when the button springs outwardly in response to the open door. Existing mailboxes are built in a wide variety of different structural designs and dimensions, and therefore conventional mechanical triggering mechanisms which are mounted to an interior wall portion of the mailbox, such as the device of U.S. Pat. No. 4,520,350, cannot be easily installed in a wide variety of differently designed mailboxes. For example, typical mechanical triggering mechanisms are not adapted for use with mailboxes having pivotal axis at the top of mailboxes such as slot-type mailboxes and wall mounted mailboxes.

A second type of device for signaling the arrival of mail is a tilt switch mounted in a bracket which mounts to the inside surface on the door of a curb side mailbox as shown in U.S. Pat. No. 5,023,595. The tilt switch within the bracket is set at a fixed angle. The bracket is not meant for use on other types of mailboxes, or if so, would require modification. As the mailbox door pivots from its closed position, the tilt switch senses the opening of the door at a fixed degree from the closed position.

Another type of device for signaling the arrival of mail is a tilt switch mounted within a triangular designed bracket which mounts to the surface of a mailbox door as shown in U.S. Pat. No. 6,046,675. As the mailbox door pivots from its closed position, the tilt switch senses the opening of the door at a fixed degree from the closed position. The tilt switch is held at a fixed angle in relation to the three triangular mounting surfaces of the bracket and does not provide any mechanism for changing the angle of the tilt switch within the bracket The tilt switch mechanism is adapted for use with various types of mailboxes employing doors with a pivotal movement from a horizontal level. In order for the device to adapt for mailboxes such as curb side, wall mounted, and slot type mailboxes with doors that pivot in a horizontal plane, it is necessary for the tilt switch to be positioned at a compromised fixed position to the three triangular mounting surfaces of the mounting enclosure. For a curb side and slot type mailbox, the mailbox door must open outwardly near 30-35 degrees before the tilt switch is engaged to close the circuitry to transmit a signal to a receiver. The near 30 to 35 degree angle opening allows mail to be deposited into the mailbox without the mechanism sending a signal to a remote receiver. The device is not suited to work on wall mounted mailboxes having door positions in a near horizontal to a minus near 30 degrees from the horizontal hinges.

Therefore it is desirable to provide a device that has an adjustable tilt switch mechanism such that the tilt switch can be positioned so the device works effectively on mailboxes with doors that open about a horizontal hinge. A door opening angle setting of near 15 degrees is preferred for each door to avoid mail deposits without the tilt switch becoming engaged, however the invention provides the user the option to select any preferred angle for the door opening of the user's choice. The adjustable tilt switch mechanism for the tilt switch angle must be adjustable enough to suit each type of mailbox that has a door with hinges that pivot upward and downward in a horizontal plane, typically, mailboxes referred to as curb side, wall mounted, and slot type. In particular, the mechanism must be adjustable to suit any of the included door angles of wall mounted mailboxes which vary from a flat horizontal of zero to near a minus near 65 degrees.

BRIEF SUMMARY OF THE INVENTION

The present invention provides a transmitting mechanism which senses the opening of mailbox doors having hinges in a horizontal plane. As the mailbox door pivots open from its closed position, the transmitting mechanism senses the opening of the mailbox door when it passes a predetermined angle from the door closed position, and sends a signal to a remote receiver which sounds an audible alarm and displays a visual light. The transmitting mechanism can sense the opening of the mailbox door at any selected angle, however an angle of near 15 degrees would be preferred to avoid the possibility of mail deposits without the transmitting mechanism sending a signal to the remote receiver.

The present invention provides a tilt switch within the transmitting mechanism enclosure. adjoined to an adjustable knob on the external surface of the enclosure. By adjusting the knob to visual indicators printed on the external surface of the enclosure, the tilt switch will close at any preferred mailbox door angle opening selected by the user. The user may select a minimal angle of near 15 degrees such that it is nearly impossible for mail deposit being made without the mechanism sending a signal to a remote receiver. Or, the user may select an angle whereby the mailbox door will open at a wider angle before a signal is sent to the receiver. The present invention is adaptable to mailbox having hinges in a horizontal plane, having doors that open either downward or upward about the hinges. These mailboxes are normally known as curb side, wall mounted, and slot type mailboxes. The base of the transmitter mechanism attaches to the surface of the mailbox doors by use of double sided tape or some other conventional means. Visual indicators such as arrows on the top of the enclosure are used to identify the positioning of the transmitting mechanism on each type of mailbox door.

DETAILED DESCRIPTION OF THE INVENTION

Figure 1:
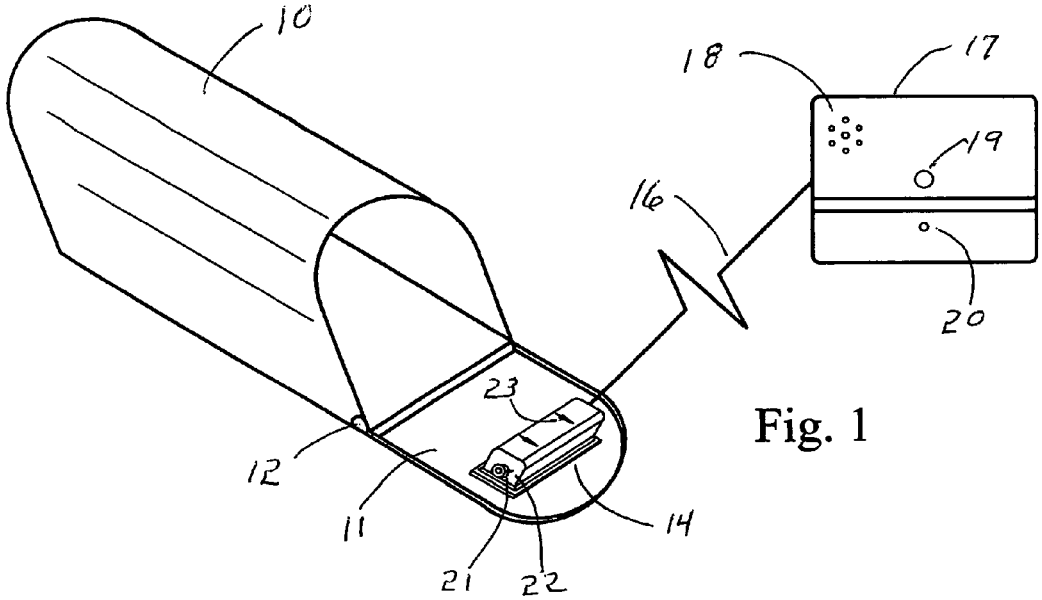
FIG. 1 is an isometric view of a total system shown with a curb side mailbox.

Referring now to the drawings, there is shown the first preferred embodiment of the present invention. FIG. 1 shows an isometric view of the present invention showing a transmitting mechanism 14 fixed to the outside surface of a door 11 of a curbside mailbox 10 by adhesive double sided tape 37 or some other conventional means. Visual indicators 23 on the top of the transmitting mechanism 14 upper enclosure 24, identifies the positioning of the transmitting mechanism 14 on the door 11. A curbside mailbox 10 typically include a door 11 that extents vertically upward from a hinge 12 in a horizontal plane at the near bottom of the door 11 when in a closed position. As the door 11 pivots open outwardly from its closed position, the transmitting mechanism senses the opening of the door 11 when it passes a predetermined angle from its closed position, and sends a signal 16 to a remote receiver 17 which sounds an audible alarm 18 and displays a visual light 19. The receiver 17 and its electronic circuitry are of conventional construction well known to those skilled in the art. Both the audible alarm 18 and the visual light 19 signals that the door 11 has been opened, which indicates to the home resident that mail may be present in the mailbox 10. The visual alarm 19 remains on until the resident resets the receiver 17 by pressing reset button 20. If the mailbox door 11 is opened when the visual light 19 is already on, the audible alarm 18 will again briefly sound. The visual light 19 will remain on until the reset button 20 is reset. The receiver can be positioned anywhere within the home or business.

Figure 2:
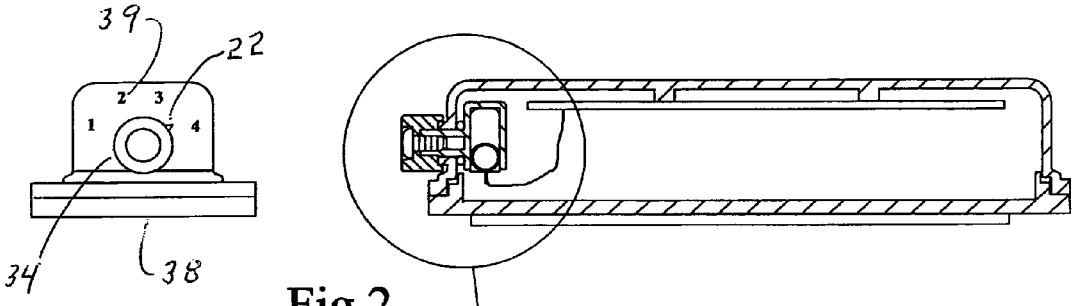
FIG. 2 is a sectional view of the transmitter mechanism assembly.
Figure 3:
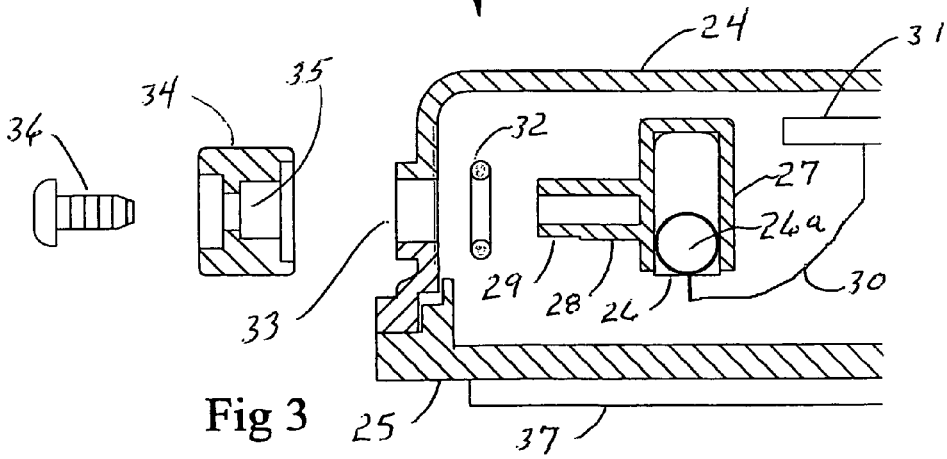
FIG. 3 is an exploded sectional view the transmitter mechanism assembly showing enjoinment of components

Next, referring to FIGS. 2 and 3, shown is the embodiment of the transmitting mechanism 14 of the present invention described in greater detail. Referring to FIG. 2 is the sectional view of the component assembly of the transmitting mechanism 14. FIG. 3 shows an exploded view of FIG. 2 of the assembly, wherein tilt switch holder 27 includes a bore in which tilt switch 26 is inserted. The tilt switch 26 holder 27, having a stem 28, having a flat locating surface 29, or some other conventional means for positioning with knob 34, is inserted through water proofing O-ring 32 and through the circular bore 33 of the transmitter mechanism 14 upper enclosure 24 and into the bore 35 of knob 34. The stem 28 of the tilt switch holder 27 is fastened to knob 34 by means of screw 36 or some other conventional means of securement. Tilt switch 26 is shown connected to transmitter circuitry board 31 by means of wire circuit 30. Transmitter circuitry board 31 is of conventional construction well known to those skilled in the art. Upper enclosure 24 of transmitter mechanism 14 is assembled to lower enclosure 25 by conventional means. Double sided adhesive tape 37 is adhered to the bottom surface of lower enclosure 25 for mounting to mailbox door 11. End view 38 of transmitting mechanism 14 shows visual indicators 39, either of numerical or other conventional identity type markings. Knob 34 is shown with an indicator pointer 22, knob 14 being adjustable for movement in either right or left direction to select predetermined angle settings of tilt switch 26, for engagement when mailbox door 11 is pivoted to an angle required to close the tilt switch 26. When tilt switch 26 is closed, a circuit 30 is completed with transmitter circuit board 31, thus a signal 16 is send to the receiver 17. A predetermined angle of the tilt switch 26 can be positioned by knob 34, whereby the transmitter mechanism 14 sends a signal 16 when the door 11 on a curb side mailbox 10, having hinges at the near bottom is pivoted open by any degree between near zero and near 90 degrees, preferably at a minimal of near 15 degrees such that mail can not be deposited without the transmitter mechanism 14 sending a signal 16 to receiver 17.

Figure 4:
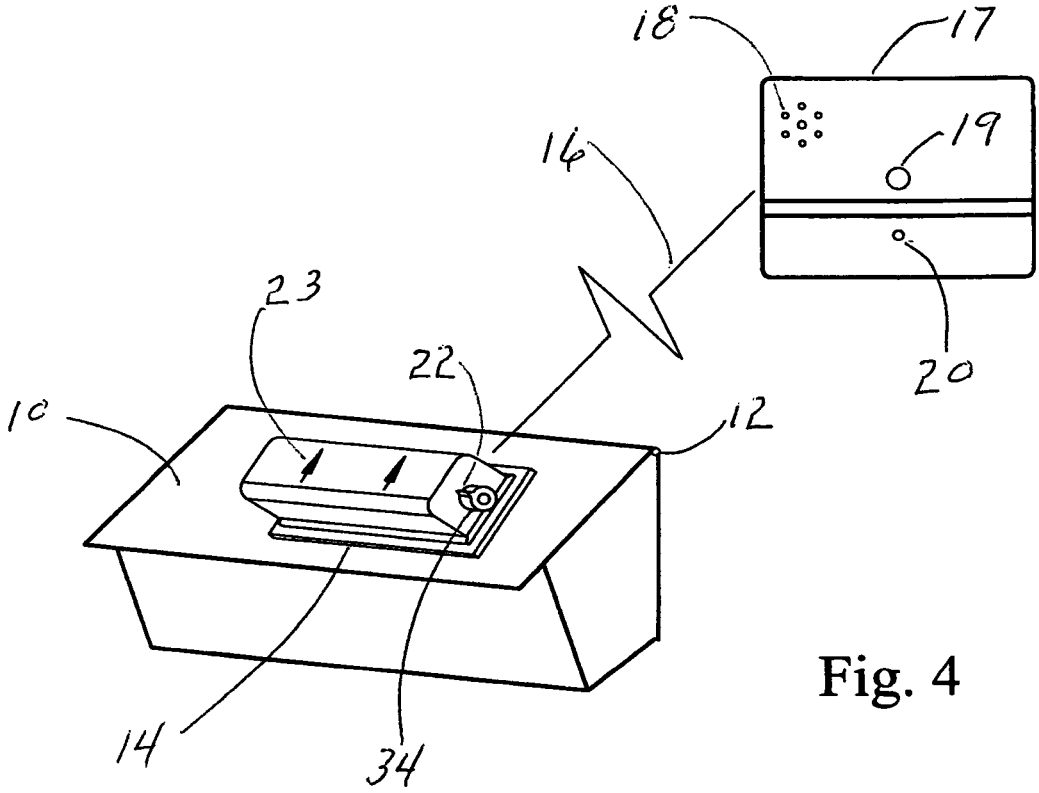
FIG. 4 is an isometric view of a total system shown with a wall mounted mailbox.

Next referring to FIG. 4, is shown an isometric view of a second preferred embodiment of the present invention showing a transmitting mechanism 14 fixed to the outside surface of a door 11 of a wall mounted mailbox 10 by adhesive double sided tape 37 or some other conventional means. Visual indicators 23 on the top of the transmitting mechanism 14 upper enclosure 24, identifies the positioning of the transmitting mechanism 14 on the door 11. Wall mounted type mailbox 10 typically includes a hinge 12 in a horizontal plane at the near top of the door 11. A closed door 11 position of a wall mounted mailbox 10 can vary from a near zero degrees in a horizontal plane to a downward plane having an angle of near 65 degrees downward from the horizontal hinge 12. As the door 11 pivots open upward from its closed position, the transmitting mechanism 14 senses the opening of the mailbox door 11 when it passes a predetermined angle from the door closed position, and sends a signal 16 to a remote receiver 17 which sounds an audible alarm 18 and displays a visual light 19. The receiver 17 and its electronic circuitry are of conventional construction well known to those skilled in the art. Both the audible alarm 18 and the visual light 19 signals that the door 11 has been opened, which indicates that mail may be present in the mailbox 10. The visual alarm 19 remains on until the resident resets the receiver 17 by pressing reset button 20. If the mailbox door 11 is opened when the visual light 19 is already on, the audible alarm 18 will again briefly sound. The visual light 19 will remain on until the reset button 20 is reset. The receiver can be positioned anywhere within the home or business. Although the tilt switch 26 can be adjusted to emit a signal 16 at any of the mailbox 10 open door angles, it is preferred that the transmitting mechanism 14 emits the signal 16 when the door 11 opens a minimal degree of near 15 to avoid mail deposits made without a signal 16 sent to the receiver 17.

Figure 5:
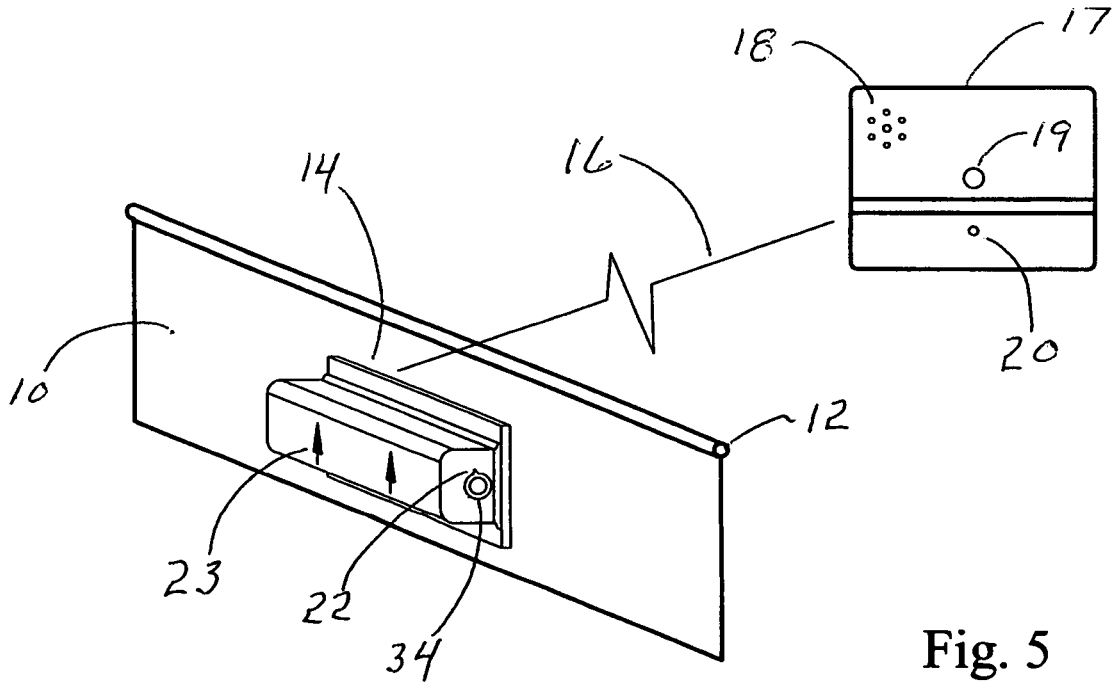
FIG. 5 is an isometric view of a total system shown with a slot type mailbox.

Next referring to FIG. 5, shown an isometric view of a third preferred embodiment of the present invention showing a transmitting mechanism 14 fixed to the outside surface of a door 11 of a slot type mailbox 10 by adhesive double sided tape 37 or some other conventional means. Visual indicators 23 on the top of the transmitting mechanism 14 upper enclosure 24, identifies the positioning of the transmitting mechanism 14 on the door 11. Slot type mailboxes typically includes a door that extends vertically downward from a horizontal hinge near the top of the door 10 when in the closed vertical position. As the door 11 pivots open from its closed position, the transmitting mechanism 14 senses the opening of the door 11 when it passes a predetermined angle from the door closed position, and sends a signal 16 to a remote receiver 17 which sounds an audible alarm 18 and displays a visual light 19. The receiver 17 and its electronic circuitry are of conventional construction well known to those skilled in the art. Both the audible alarm 18 and the visual light 19 signals that the door 11 has been opened, which indicates that mail may be present in the mailbox 10. The visual alarm 19 remains on until the resident resets the receiver 17 by pressing reset button 20. If the mailbox door 11 is opened when the visual light 19 is already on, the audible alarm 18 will again briefly sound. The visual light 19 will remain on until the reset button 20 is reset. The receiver can be positioned anywhere within the home or business. Although the tilt switch 26 can be adjusted to emit a signal 16 at any of the mailbox 10 open door angles, it is preferred that the transmitting mechanism 14 emits the signal 16 when the door 11 opens a minimal degree of near 15 to avoid mail deposits made without a signal 16 sent to the receiver 17.

Figure 6:
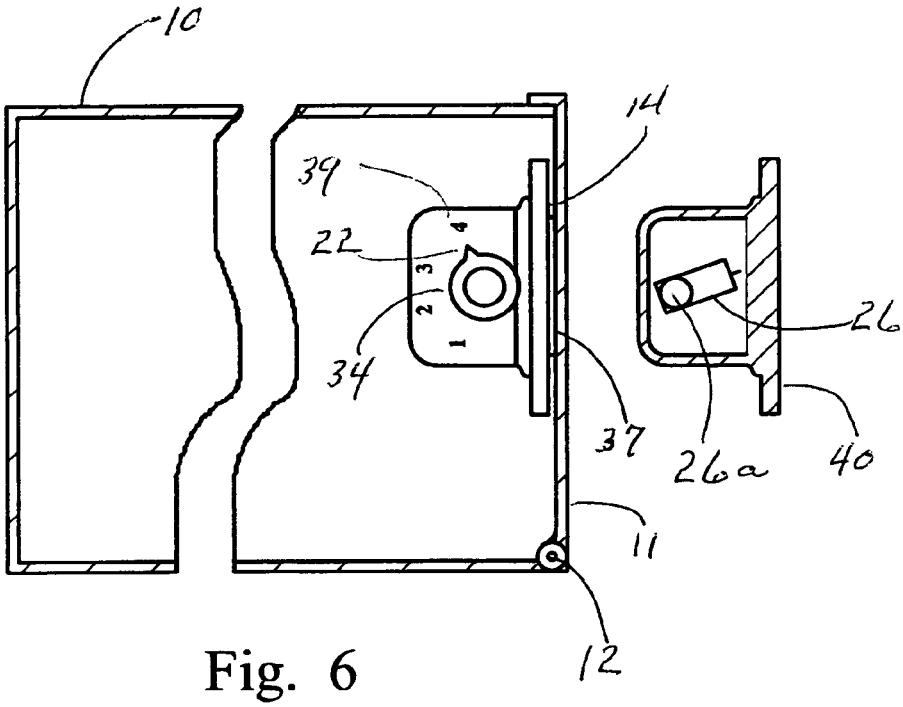
FIG. 6 is a side view of the transmitter mechanism mounted to the inside door surface of a curbside mailbox with the mailbox door in a closed position.
Figure 7:
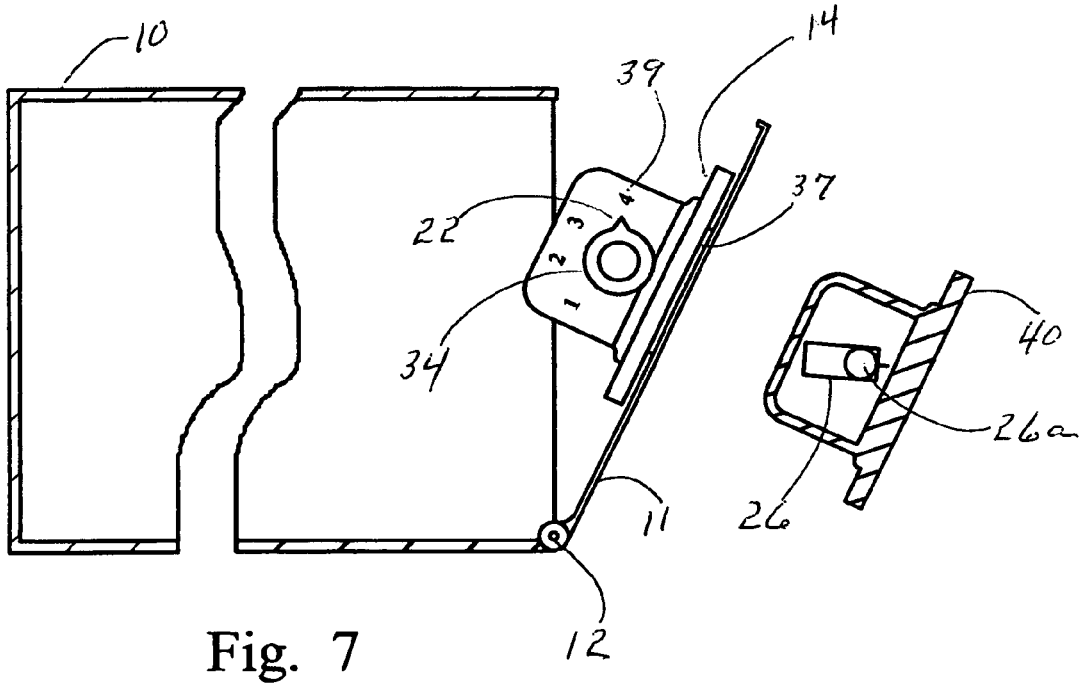
FIG. 7 is a side view of the transmitter mechanism mounted to the inside door surface of a curbside mailbox with the mailbox door in an open position.

Next, referring to FIGS. 6 and 7 is shown transmitting mechanism 14 mounted with double sided tape 37 or some other convention means to the inside surface of door 11 of a curb side type mailbox 10. Curb side type mailbox 10 typically includes a door that extends vertically upward from a horizontal hinge near the bottom of the door 11 when in the closed position. When the door 11 is closed, as shown in FIG. 6, the tilt switch 26 is in an open position as seen in sectional view 40, the knob 34 having its pointer 22 set at near numeral 4 on the visual indicator 39. As the door 11 opens to the position shown in FIG. 7, the door 11 pivots outwardly about hinge 12 located near the bottom of the door 11. As the door 11 pivots opens outwardly, the tilt switch 26 ball 26*a* rolls under the force of gravity to the other end of the tilt switch 26 when the door 11 has pivoted to near 15 degrees from its closed vertical position. When the tilt switch 26 ball 26*a* has rolled to the other end of the tilt switch 26, the circuit is completed through wire circuit 30 which causes the transmitter mechanism 14 to transmit signal 16 to the receiver 17, thus activating the visual light 19 and sound alert 18, to notify the recipient that the mailbox door 11 has been opened.

Figure 8:
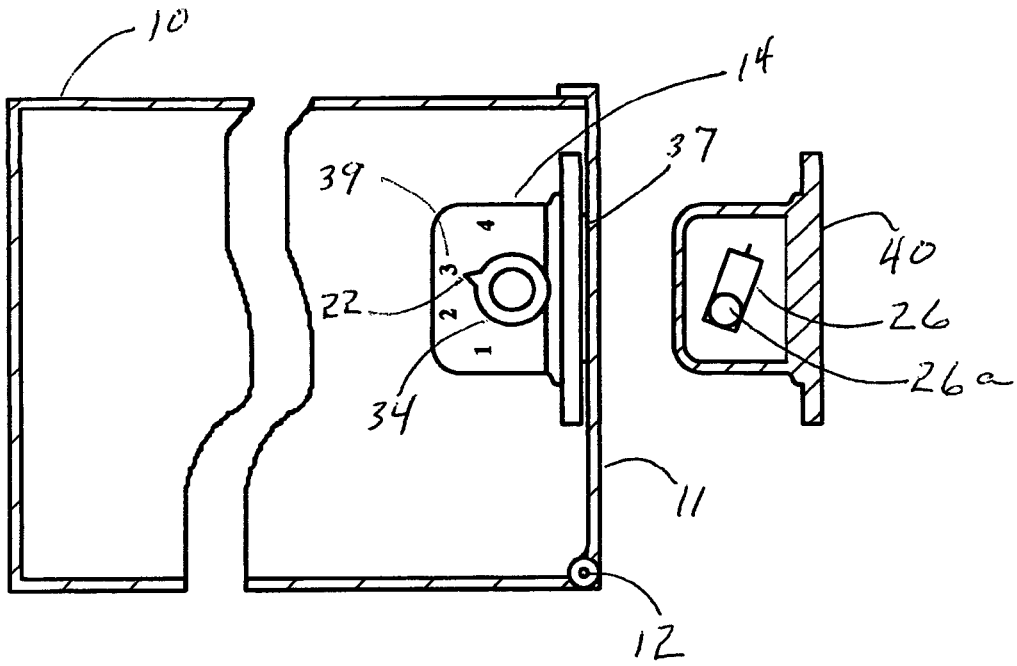
FIG. 8 is a side view of the transmitter mechanism mounted to the inside door surface of a curbside mailbox with the mailbox door in a closed position.
Figure 9:
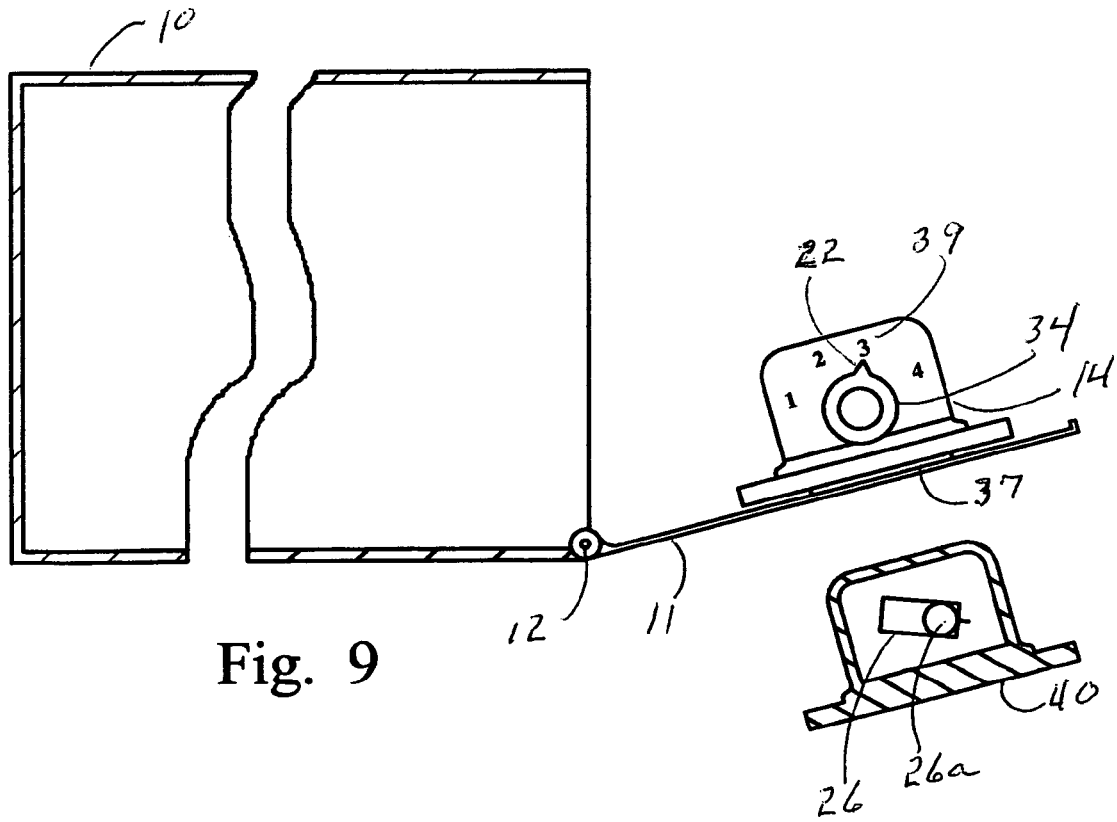
FIG. 9 is a side view of the transmitter mechanism mounted to the inside door surface of a curbside mailbox with the mailbox door in an extended open position.

Next referring to FIGS. 8 and 9 is shown transmitting mechanism 14 mounted with double sided tape 37 or some other convention means to the inside surface of door 11 of a curb side type mailbox 10. Curb side type mailbox 10 typically includes a door that extends vertically upward from a horizontal hinge near the bottom of the door 11 when in the closed position. When the door 11 is closed, as shown in FIG. 6, the tilt switch 26 is in an open position as seen in sectional view 40. The knob 34 having its pointer 22 set at near numeral 3 on the visual indicator 39. As the door 11 pivots opens outwardly about a horizontal hinge at the near bottom of the door, the tilt switch 26 ball 26*a* rolls under the force of gravity to the other end of the tilt switch 26 when the door 11 has pivoted to near 90 degrees from its closed vertical position. When the tilt switch 26 ball 26*a* rolls to the other end of the tilt switch 26, the circuit is completed through wire circuit 30 which causes the transmitter mechanism 14 to transmit signal 16 to the receiver 17, thus activating the visual light 19 and sound alert 18, to notify the recipient that the mailbox door 11 has been opened. Changing the knob pointer 22 on the visual indicator 39 to 3 delays sending signal 16 until the mailbox door 11 is opened to a wider openings as shown in FIG. 9. The pointer 22 on knob 34 can be set anywhere on the visual indicator 39 to allow the tilt switch 26 engagement when the door 11 is opened anywhere from near zero degrees to near 90 degrees.

Figure 10:
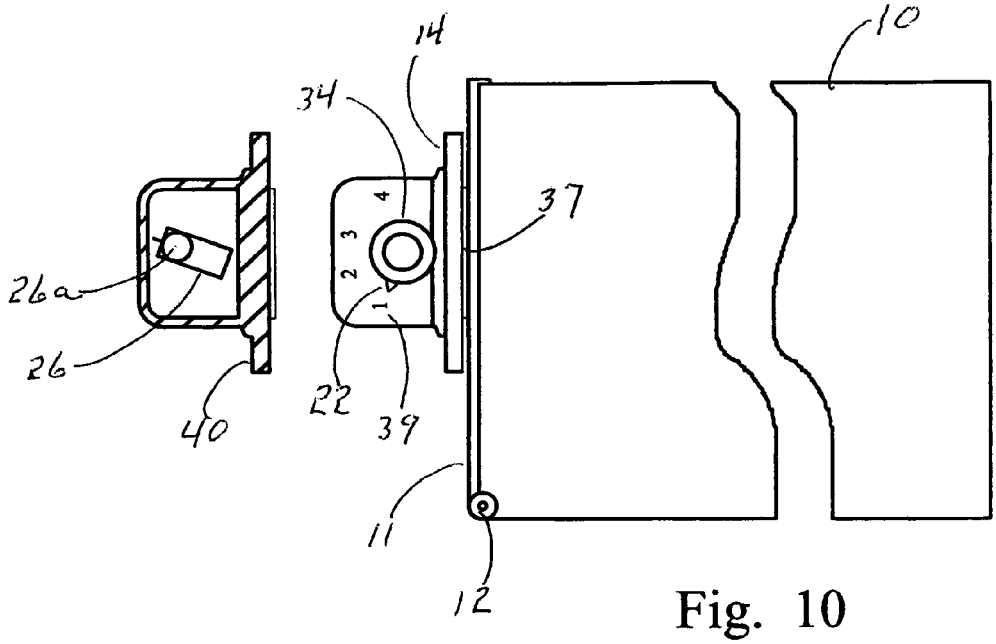
FIG. 10 is a side view of the transmitter mechanism mounted to the outside door surface of a curbside mailbox with the mailbox door in a closed position.
Figure 11:
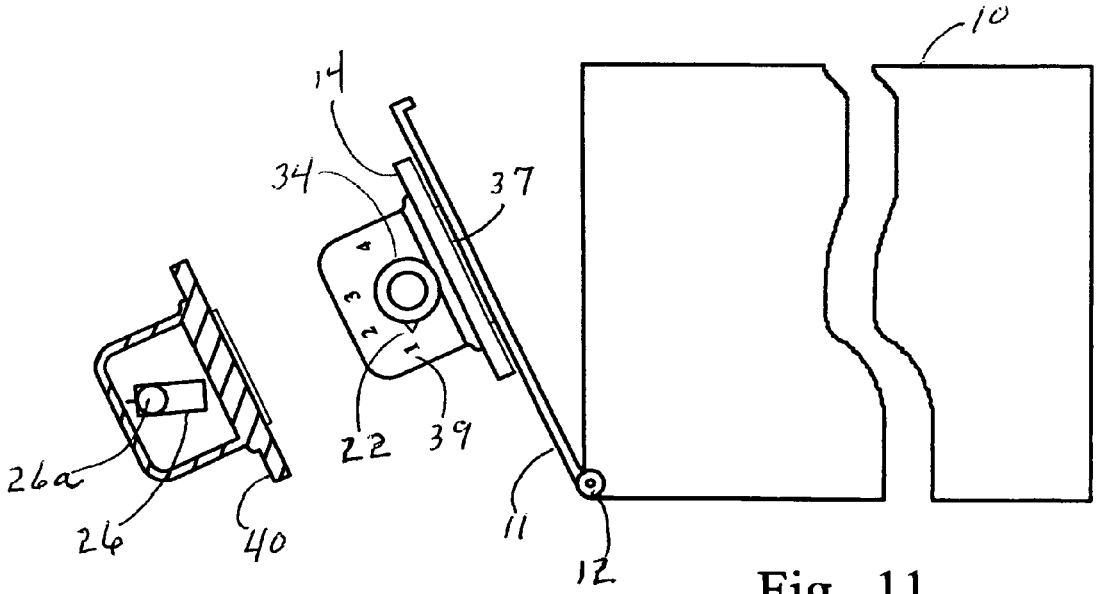
FIG. 11 is a side view of the transmitter mechanism mounted to the outside door surface of a curbside mailbox with the mailbox door in an open position.

Next, referring to FIG. 10 and 11 is shown transmitting mechanism 14 mounted with double sided tape 37 or some other convention means to the outside surface of door 11 of a curb side type mailbox 10. Curb side type mailbox 10 typically includes a door that extends vertically upward from a horizontal hinge near the bottom of the door 11 when in the closed position. When the door 11 is closed, as shown in FIG. 10, the tilt switch 26 is in an open position as seen in sectional view 40. The knob 34 having its pointer 22 set at near numeral 1 on the visual indicator 39. As the door 11 opens to the position shown in FIG. 11, the door 11 is shown pivoted outwardly about a hinge mechanism 12 located near the bottom of the door 11. As the door 11 pivots open outwardly, the tilt switch 26 ball 26*a* rolls under the force of gravity to the other end of the tilt switch 26 when the door 11 has pivoted from near 15 degrees from its closed vertical position. When the tilt switch 26 ball 26*a* rolls to the other end of tilt switch 26, the circuit is completed through wire circuit 30 which causes the transmitter mechanism 14 to transmit signal 16 to the receiver 17, thus activating the visual light 19 and sound alert 18, to notify the recipient that the mailbox door 11 has been opened. Thus, by mounting the transmitting mechanism 14 on the outside of the mailbox 10 door 11 and setting the knob 34 pointer 22 to visual indicator 39, the transmitting mechanism 14 will send a signal when the mailbox 10 door 11 is opened near a preferred 15 degrees.

Figure 12:
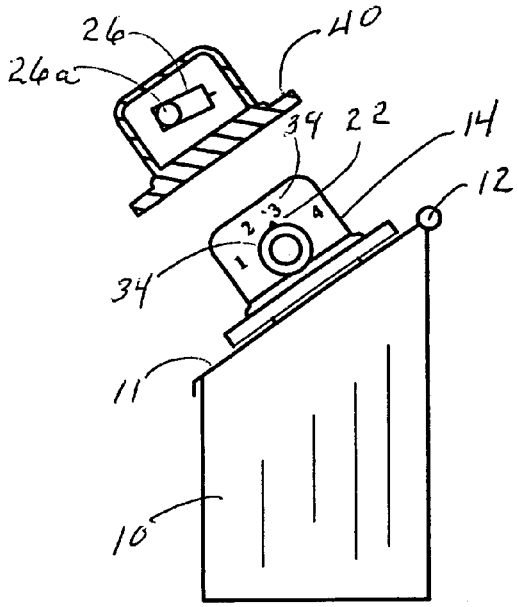
FIG. 12 is a side view of the transmitter mechanism mounted to the outside door surface of a wall mounted mailbox having a door at an angle near 65 degrees from the horizontal with the mailbox door in a closed position.
Figure 13:
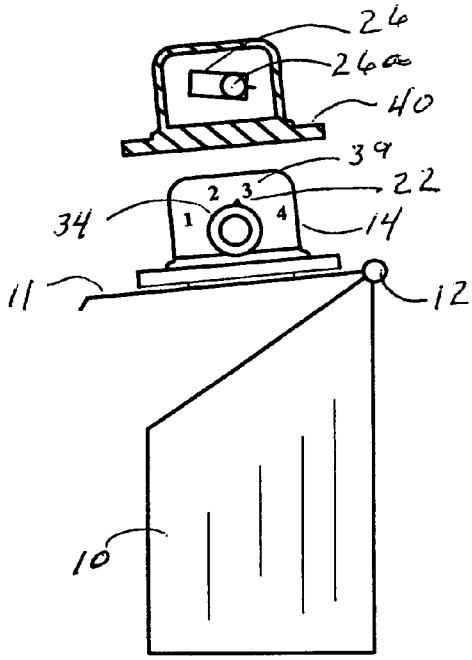
FIG. 13 is a side view of the transmitter mechanism mounted to the outside door surface of a wall mounted mailbox having a door at an angle of near 65 degrees from the horizontal with the mailbox door in an open position.

Next, referring to FIGS. 12 and 13 is shown transmitting mechanism 14 mounted with double sided tape 37 or some other convention means to the outside surface of door 11 of a wall mounted type mailbox 10 shown with a door 11 in a closed position near minus 65 degrees from the horizontal. Wall mounted type mailbox 10 typically includes a hinge 12 in a horizontal plane at the near top of the mailbox 10 door 11. Closed door 11 positions of a wall mounted mailbox 10 can vary from a near zero degrees in a horizontal plane to a downward angle of near 65 degrees from the horizontal hinge 12. When the door 11 is closed, as shown in FIG. 12, the tilt switch 26 is in an open position as seen in sectional view 40, the knob 34 having its pointer 22 set at near numeral 3 on the visual indicator 39. As the door 11 opens as shown in FIG. 13, the door 11 pivots upwardly about a hinge mechanism 12 located near the top of the door 11. As the door 11 pivots open upwardly, the tilt switch 26 ball 26*a* rolls under the force of gravity to the other end of the tilt switch 26 when the door 11 has pivoted from near 15 degrees from its closed vertical position. When the tilt switch 26 ball 26*a* rolls to the other end of the tilt switch 26, the circuit is completed through wire circuit 30 which causes the transmitter mechanism 14 to transmit signal 16 to the receiver 17, thus activating the visual light 19 and sound alert 18, to notify the recipient that the mailbox door 11 has been opened.

Figure 14:
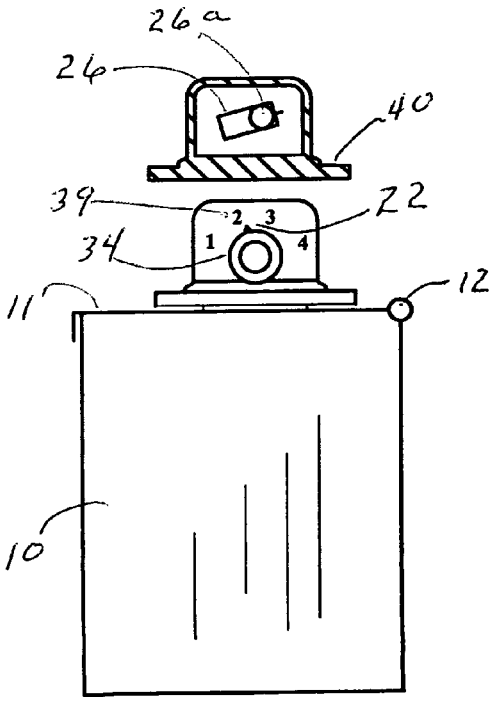
FIG. 14 is a side view of the transmitter mechanism mounted to the outside door surface of a wall mounted mailbox having a door in a near horizontal plane with the mailbox door in closed position.
Figure 15:
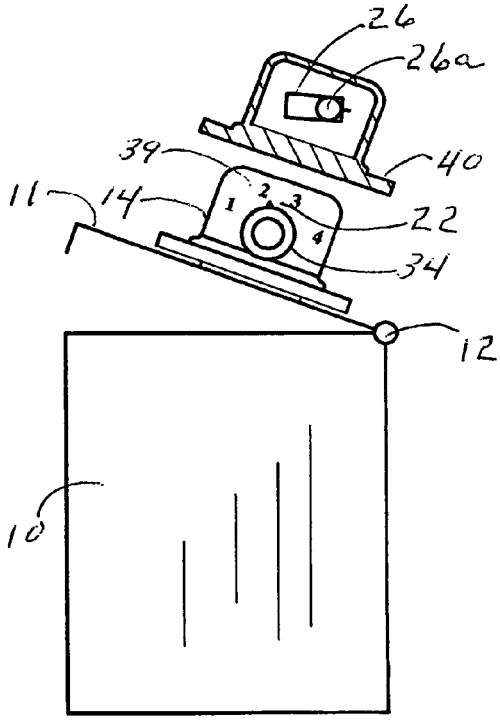
FIG. 15 is a side view of the transmitter mechanism mounted to the outside door surface of a wall mounted mailbox having a door in a near horizontal plane with the mailbox in an open position.

Next, referring to FIGS. 14 and 15 is shown transmitting mechanism 14 mounted with double sided tape 37 or some other convention means to the outside surface of door 11 of a wall mounted type mailbox 10 shown with a door 11 in a closed position in a horizontal plane near zero degrees. Wall mounted type mailbox 10 typically includes a hinge 12 in a horizontal plane at the near top of the door 11. A closed door 11 position of a wall mounted mailbox 10 can vary from a near zero degrees in a horizontal plane to a downward angle of near 65 degrees from the horizontal hinge 12. When the door 11 is closed, as shown in FIG. 14, the tilt switch 26 is in an open position as seen in sectional view 40. The knob 34 having its pointer 22 set at near numeral 2 on the visual indicator 39. As the door 11 opens upward to the position shown in FIG. 15, the door 11 pivots about a horizontal hinge mechanism 12 located near the top of the door 11. As the door 11 pivots upward from a closed position, the tilt switch 26 ball 26*a* rolls under the force of gravity to the other end of the tilt switch 26 when the door 11 has pivoted from near 15 degrees from its closed position. When the tilt switch 26 ball 26*a* rolls to the other end of the tilt switch 26, the circuit is completed through wire circuit 30 which causes the transmitter mechanism 14 to transmit signal 16 to the receiver 17, thus activating the visual light 19 and sound alert 18, to notify the recipient that the mailbox door 11 has been opened. The transmitter mechanism can be adjusted by the knob 34 to position the angle of the tilt switch 26 for engagement on any wall mounted mailbox door 11 when the door 11 is opened from any angle of near zero horizontally to near minus 65 degrees.

Figure 16:
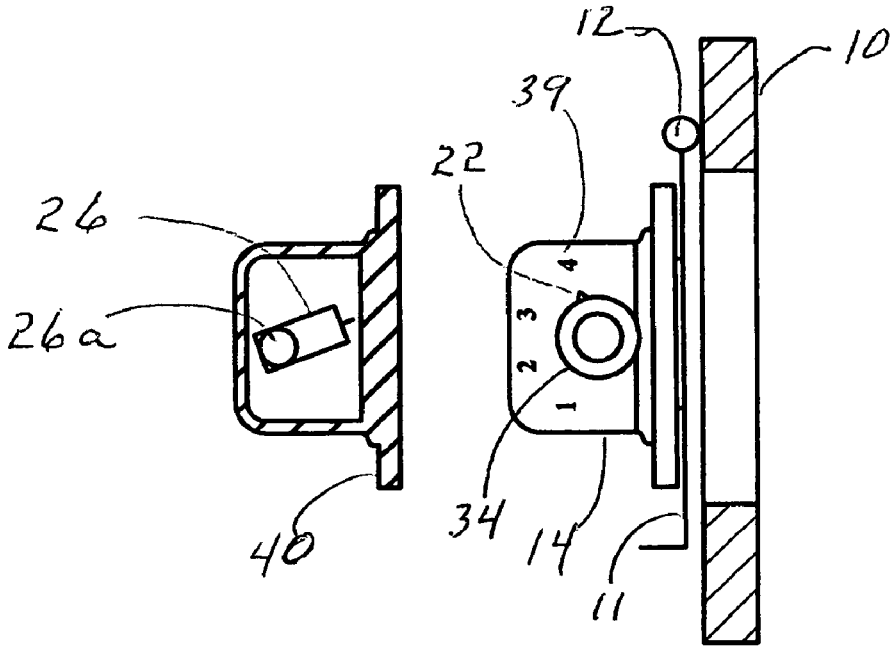
FIG. 16 is a side view of the transmitter mechanism mounted to the outside door surface of a slot type mailbox with the mailbox door in a closed position.
Figure 17:
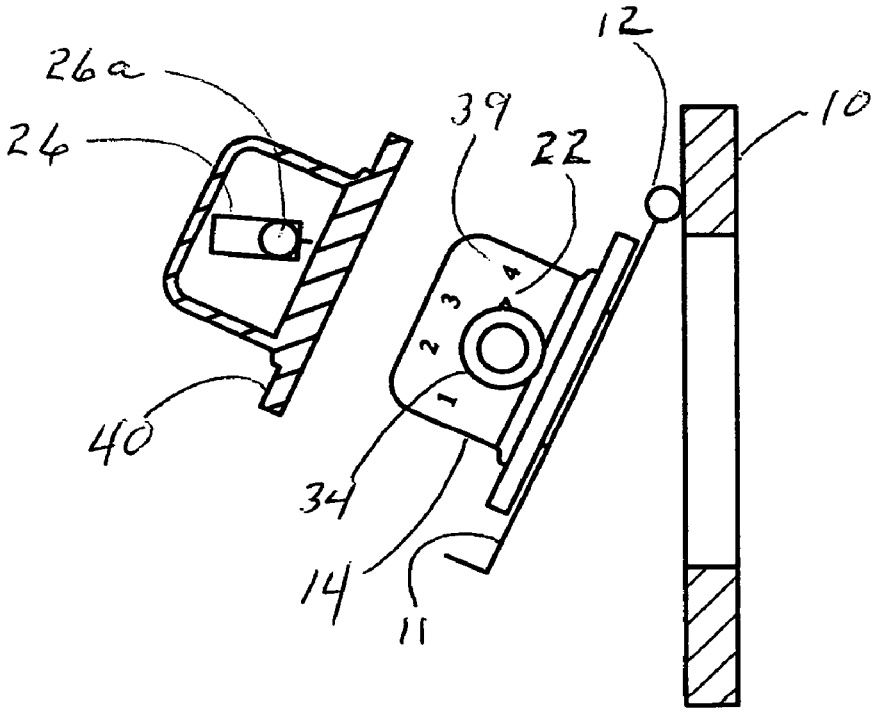
FIG. 17 is a side view of the transmitter mechanism mounted to the outside door surface of a slot type mailbox with the mailbox door in an open position.

Next, referring to FIGS. 16 and 17 is shown transmitting mechanism 14 mounted with double sided tape 37 or some other convention means to the outside surface of door 11 of a slot type mailbox 10. Slot type mailboxes typically includes a door in a closed position that extends vertically downward from a horizontal hinge near the top of the door 11. When the door 11 is closed, as shown in FIG. 16, the tilt switch 26 is in an open position as seen in sectional view 40. The knob 34 having its pointer 22 set at near numeral 4 on the visual indicator 39. As the door 11 opens to the position shown in FIG. 17, the door 11 pivots outwardly about a hinge mechanism 12 located near the top of the door 11. As the door 11 pivots open outwardly, the tilt switch ball rolls under the force of gravity to the other end of tilt switch 26, when the door 11 has pivoted from near 15 degrees from its closed vertical position. When the tilt switch 26 ball 26*a* has rolled to the other end of the tilt switch 26, the circuit is completed through wire circuit 30 which causes the transmitter mechanism 14 to transmit signal 16 to the receiver 17, thus activating the visual light 19 and sound alert 18, to notify the recipient that the mailbox door 11 has been opened.

What is claimed is:

1. A transmitter mechanism for indicating when mail has been deposited in a mailbox having a pivotable door, wherein said mechanism indicates the arrival of mail by transmitting a signal to a remote receiver when said door has been opened, said mechanism comprising:

a) a tilt switch including a ball or mercury, said tilt switch connected to a circuit board to transmit said signal;

b) an enclosure having a mounting base affixed to said door, said door hinged to said mailbox such that said tilt switch positioned within said enclosure is activated when said mailbox door is opened;

c) a turning knob with internal bores respectively receiving a portion of said enclosure and a portion of a tilt switch holder, said knob being turnable to select a predetermined angle setting of said tilt switch, said turning knob having an indicator pointer on an external circular surface thereof;

d) said tilt switch holder with an internal bore receiving said tilt switch, and said portion defining a circular stem attached to said turning knob and to said enclosure;

e) indicia on a top surface of the enclosure opposite said mounting base for indicating the proper mounting orientation of said enclosure on said door such that said tilt switch is activated when said mailbox door is opened; and f) indicia on an external side surface of the enclosure for indicating the position of said knob such that said indicator pointer is set to an indicated position corresponding to said predetermined angle setting of said tilt switch whereby said tilt switch will be activated when said door of said mailbox is opened.

2. The mechanism of claim 1 wherein said enclosure is mounted on an outside surface of said door.

3. The mechanism of claim 1 wherein said mailbox is a wall mounted mailbox and said mailbox door is opened upwardly.

4. The mechanism of claim 1 wherein said mailbox is a slot mailbox and said mailbox door is opened upwardly.

5. The mechanism of claim 1 wherein said remote receiver includes an audible alarm and a visual alarm to indicate mail has been deposited in the mailbox.

6. The mechanism of claim 1 wherein said mailbox is a curbside mailbox and said mailbox door is opened downwardly.

7. The mechanism of claim 1 wherein said enclosure is mounted on an inside surface of said door.

* * * * *